United States Patent [19]

Budliger

[11] Patent Number: 4,717,405

[45] Date of Patent: Jan. 5, 1988

[54] STIRLING MACHINE

[75] Inventor: Jean-Pierre Budliger, Onex, Switzerland

[73] Assignee: Battelle Memorial Institute, Geneva, Switzerland

[21] Appl. No.: 915,100

[22] Filed: Oct. 3, 1986

[30] Foreign Application Priority Data

Oct. 7, 1985 [CH] Switzerland ..... 4325/85

[51] Int. Cl.[4] ..... F25B 9/00

[52] U.S. Cl. ..... 62/6; 60/517; 60/520

[58] Field of Search ..... 60/517, 520; 62/6

[56] References Cited

U.S. PATENT DOCUMENTS 3,858,802 1/1975 Stobart ..... 60/517 X 4,458,495 7/1984 Beale ..... 62/6

4,610,143 9/1986 Stolfi et al. ..... 62/6

*Primary Examiner*—Allen M. Ostrager

*Attorney, Agent, or Firm*—Cushman, Darby & Cushman

[57] ABSTRACT

A Stirling-cycle assembly comprises an engine with a displacer piston mounted in a cylinder and defining a compression compartment and an expansion compartment respectively of a gaseous working fluid. These compartments communicate via a heat exchanger associated with a hot source, a regenerator and a heat exchanger associated with a heat sink. The engine is coupled to a heat pump having the same structure, via a resonance tube acting as an oscillatory drive member. The displacer piston of the heat pump is associated with a return means, e.g. a rod mounted in sealing-tight relationship in a closedchamber disposed on the compression compartment side.

10 Claims, 14 Drawing Figures

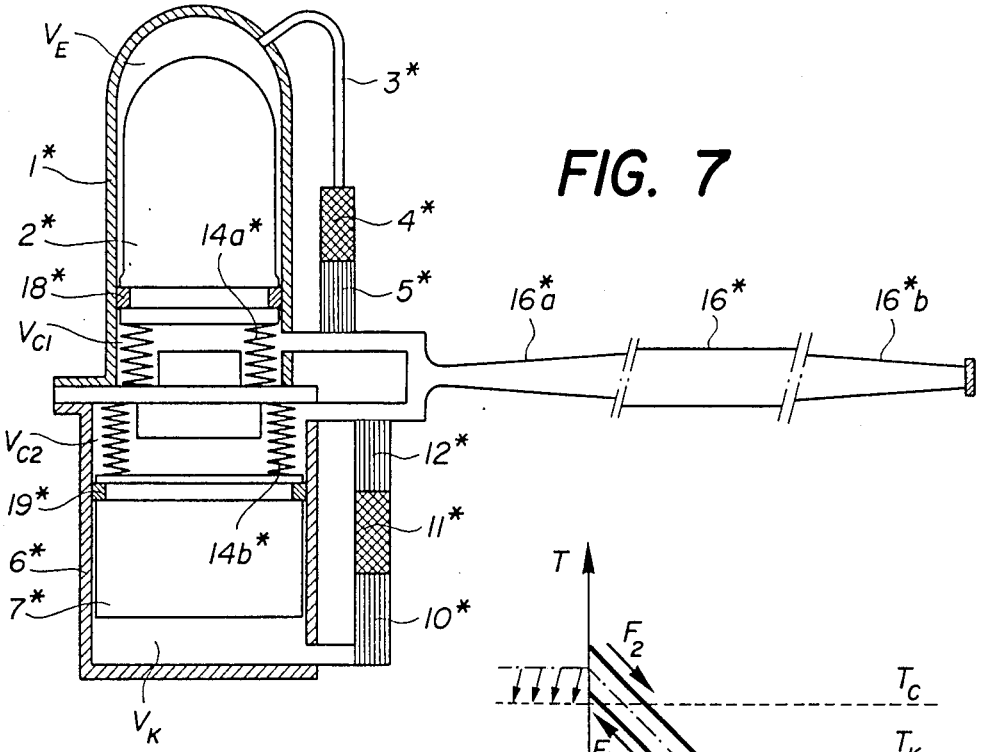
FIG. 7
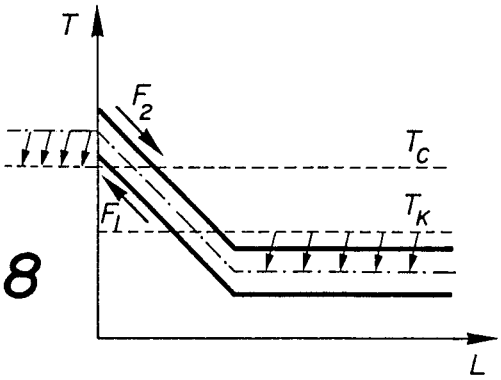
FIG. 8
FIG. 9
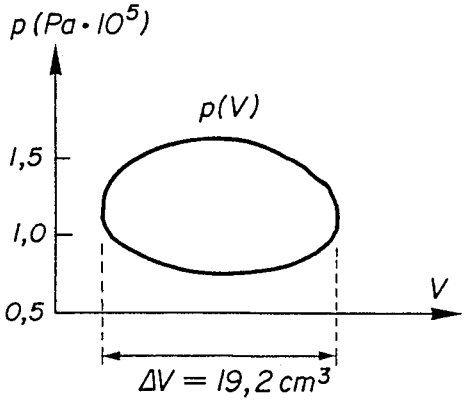
FIG. 10
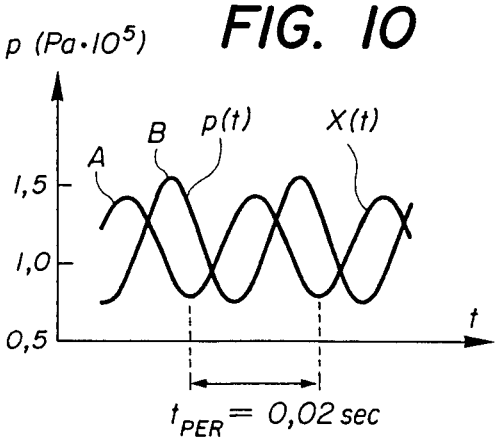

STIRLING MACHINE

This invention relates to a Stirling machine comprising a displacer piston mounted in a cylinder to define two variable-volume compartments for the compression and expansion respectively of a gaseous working fluid contained in said machine, the compression compartment communicating with the expansion compartment via a conduit containing a heat exchanger adapted to be associated with a hot source, a regenerator and a heat exchanger adapted to be associated with a heat sink and an oscillatory member synchronized with said transfer piston.

At the start of the seventies, U.S. Pat. No. 4,183,214 in the name of W. Beale described an assembly in which a Stirling engine drives a Stirling heat pump. This is a single-cylinder free-piston machine and this configuration necessitates storing the energy in the form of a movable mass, the function of which is to absorb the energy produced during the period of the cycle in which the engine delivers work and restore it during the heat pump cycle. This work has formed the subject of an experimental 100 W design (see W. T. Beale, C. F. Rankine, D. Gedeon, C. Kinzelman: Duplex Stirling heating-only gas-fired heat pump feasibility study—NTIS PB 81-181323/GRI 79/0047).

This heat pump essentially comprises three movable elements disposed in the same cylinder. A heavy central drive piston divides the working volume into an engine compartment and a heat-pump compartment, each compartment having a lightweight transfer piston. The movement of the central drive piston causes a periodic variation in the pressure of gas in the engine compartment and a similar variation in phase opposition in the heat-pump compartment. As a result of the displacer piston movements the gas periodically moves with a reciprocating movement between the expansion chamber and the compression chamber, via, respectively, a hot exchanger, a hot regenerator and a cold exchanger of the engine and an exchanger associated with a cold source, a cold regenerator and an exchanger adapted to give up the heat pumped from the cold source.

The movements of the two displacer pistons take place prior to the movement of the central drive piston so that the expansion of the gas takes place when most of the gas is contained respectively in the hot expansion chamber of the engine compartment and in the cold expansion chamber of the heat pump. Conversely, compression of the gas takes place in each compartment when most of the gas is contained in the compression chambers at temperatures near ambient temperature.

The periodic and synchronous movement of the three pistons can be maintained simply by the pressure of the working gas acting on the different surfaces of the respective pistons. The drive piston is suspended by the cushions of gas formed by the engine compartment on the one hand and the heat-pump compartment on the other hand and oscillates under resonant conditions. The displacer pistons are kept oscillating by the action of other cushions of gas delivered by the piston rods or return springs which act either between the displacer pistons and the drive piston on the one hand and the respective ends of the cylinder, on the other hand.

The U.S. Pat. Nos. 3,928,974 and 4,044,558 in the name of Benson describe another Stirling engine and Stirling heat pump assembly comprising a displacer piston of the engine connected to the displacer piston of the heat pump by a rod and two dynamically balanced opposed free pistons which compress and expand the common working gas in a closed circuit. The cycles of the engine and of the heat pump are conventional sinusoidal Stirling cycles with constant-volume heat exchange and isothermal varying-volume chambers. In practice, however, there is a substantial deviation which increases with reducing temperature difference between the hot exchanger and the cold exchanger and with increasing pressure ratio of the cycle. These deviations are therefore far less important in the case of a Stirling engine with a 600° C. temperature gap between the hot and cold exchangers than in the case of a heat-pump with a relatively low temperature difference between the source and the heat sink.

We think that the thermally driven heat pump solutions proposed by Beale and Benson have a number of disadvantages. In practice it is difficult to maintain synchronism of three or four free pistons simply by the action of pneumatic springs. The number of seals is considerable. This leads to leakage and friction losses due to wear problems necessitating regular maintenance. In the Beale solution, it is difficult perfectly to balance the mass of a relatively heavy drive piston. Again in this solution the relatively low energy density of the heat pump compared with the engine has resulted in the piston being given different diameters. In the Benson system, the large dead volume reduces the pressure ratio of the working gas and necessitates compact and expensive heat exchangers.

It will be apparent that in the Benson system the gas is supplied and withdrawn periodically from the displacer part of the engine and the heat pump by means of separately disposed oscillatory drive pistons. These drive pistons serve periodically to accumulate gas and store the mechanical energy which is then returned to the transfer volumes. The process is so arranged that the pressure reduces at the high-temperature maximum expansion volume of the engine and at the low-temperature maximum expansion volume of the heat pump. Conversely, the pressure increases when the two compression volumes are large.

Philips has taken up an interesting concept known as the VM cycle (after its inventor Vuilleumier) which requires no drive piston. This solution comprises just two free displacer pistons oscillating with a phase-shift between the two pistons. Their movement subjects the entire working volume to a periodically varying common pressure. The gas in the high-temperature expansion chamber and in the cold expansion chamber undergoes an engine cycle which delivers work, the work being absorbed in the common compression chamber. The only appreciable pressure differences occur at the seals of the relatively small volumes of the pneumatic cushions used as return springs.

A considerable disadvantage of the VM cycle is associated with the relatively low pressure ratios resulting from the periodic operation of such a system. A brief analysis shows that it limits the coefficient of performance (COP) to relatively low values. The dead volumes must be kept extremely small and this is particularly difficult to achieve with free pistons. It is also difficult to achieve stability conditions for the two oscillatory transfer free pistons.

Volume I, page 123, of the proceedings of the XVI$^{th}$ Congres International du Froid (Paris 1983) refers to the possibility of achieving a Stirling cycle by producing pressure variations from outside by the use of the thermo-acoustic oscillation of gases, which can be generated in open tubes having a longitudinal temperature gradient. It is therefore apparent that this pressure variation is the result of a temperature variation induced in a portion of the tube, the temperature variation being produced by an external heat source.

This pressure variation in the tube is not therefore due to a mechanical effect but to a thermal effect.

The object of this invention is at least partially to obviate the disadvantages of the above-mentioned solutions.

To this end, the invention relates to a Stirling machine according to claim 1.

The main advantage of the solution proposed as compared with a Vuilleumier system lies in the fact that the pressure ratio is increased as a result of the resonance tube. In the case of a Stirling engine and heat pump assembly having a free piston, the heavy drive piston is replaced by a resonance tube. This design enables the number and size of the seals subjected to considerable pressure differences to be reduced, thus reducing the frictional losses, which form one of the basic problems of Stirling engines. This reduction in the number and size of the seals also reduces the maintenance problems, thus increasing reliability and operating life.

The need for only two transfer pistons at maximum simplifies the control of the system and allows great flexibility in matching the heat pump power to demand.

The oscillating pressure wave in the resonant tube enables pressure variations $P_{max}/P_{min}$ to be obtained from 1.5 to 2.0, even with relatively large dead volumes in the engine and heat-pump compartments. This enables the cross-section of the flow passages through the heat exchangers to be increased to some extent, thus reducing losses due to resistance to flow. The dead volumes in the displacer piston chambers can also be increased, something which promotes the reliability of operation of free-piston mechanisms.

It will be apparent hereinafter that one of the foreseeable advantages of the invention lies in the heat pumping effect which can occur in the resonarce tube itself. Because of the wave mechanism, the central part of the resonance tube will be cooled below ambient temperature so that it can form the cold source of the heat pump, the absorbed heat of which will be recovered in another part of said tube. This special feature also enables the size of the heat-pump compartment to be reduced by comparison with the heat pump systems of the double Stirling type provided with a drive piston.

The accompanying drawing is a highly diagrammatic illustration by way of example of various aspects of the machine according to the invention.

FIGS. 5 to 7 are three diagrams of three aspects of the embodiment shown in FIG. 1;

FIG. 8 is an explanatory diagram showing the function of the variant according to FIG. 6.

FIGS. 9 and 10 are graphs respectively showing pressure against movement and pressure against time measured during tests.

Figure 1:
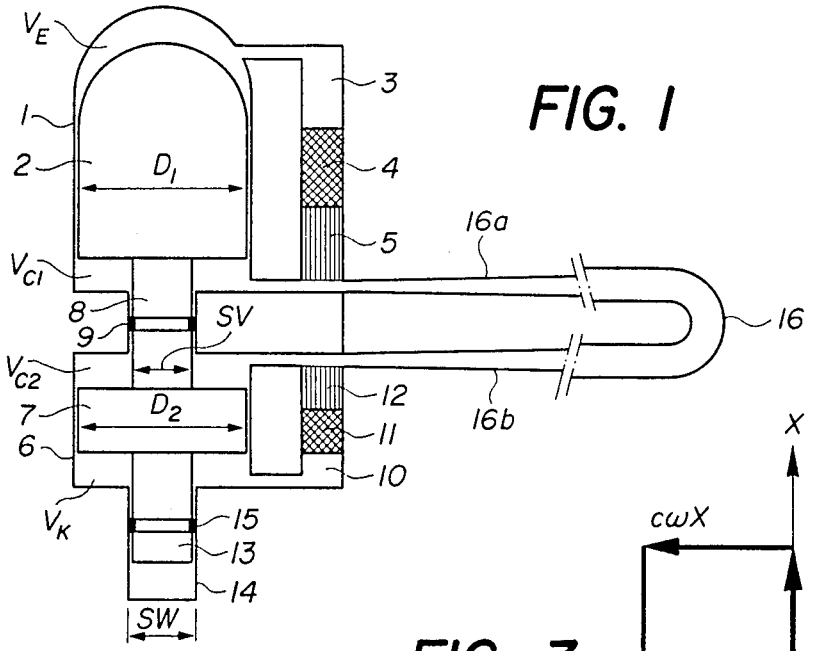
FIG. 1 is a diagram relating to one embodiment of a Stirling engine and heat pump assembly.

The assembly illustrated in FIG. 1 comprises an engine compartment 1 formed by a cylinder containing a displacer piston 2 which defines an expansion volume $V_E$ and a compression volume $V_{C1}$ in said cylinder. These two volumes communicate with one another via a heat exchanger 3 associated with a hot source (not shown), a regenerator 4 and a heat exchanger 5 associated with a heating circuit (not shown). The assembly also comprises a second compartment 6 formed by a cylinder coaxial with that of the engine compartment 1, the second compartment forming a heat pump. The second compartment 6 contains a displacer piston 7 connected to the displacer piston 2 by a rod 8 of section SV associated with a seal 9. In the compartment 6 the piston 7 defines a compression volume $V_{C2}$ and an expansion volume $V_K$. These two volumes communicate with one another via a heat exchanger 10 associated with a low-temperature heat source, a regenerator 11 and a heat exchanger 12 adapted to give up the heat to the same heating circuit. The displacer piston 7 is also provided with a rod 13 mounted slidably in a chamber 14 of section SW hermetically closed by a seal 15. This chamber 14 forms a pneumatic return spring.

The two compartments 1 and 6 which are hermetically separated by the rod 8 associated with the seal 9 are connected by a resonance tube 16, the two ends of which terminate in the two compression volumes $V_{C1}$ and $V_{C2}$ respectively. This resonance tube, the operating conditions of which will be analyzed, acts as a drive piston transmitting the work from the engine compartment 1 to that of the heat pump 6.

If we initially consider the operating cycle of the engine compartment 1, the expansion volume $V_E$ is at high temperature while the compression volume $V_{C1}$ is at low temperature, which in this case is close to ambient temperature. These two volumes vary cyclically following upon the reciprocating movement of the transfer piston 2. Since the column of gas in the resonance tube 16 is subjected to a pressure wave which causes it to oscillate at the frequency of the transfer piston 2, said resonance tube acts as a drive piston which periodically compresses and expands the gas contained in the drive compartment 1 and, in phase opposition, in the heat pump compartment 6.

Figure 2:
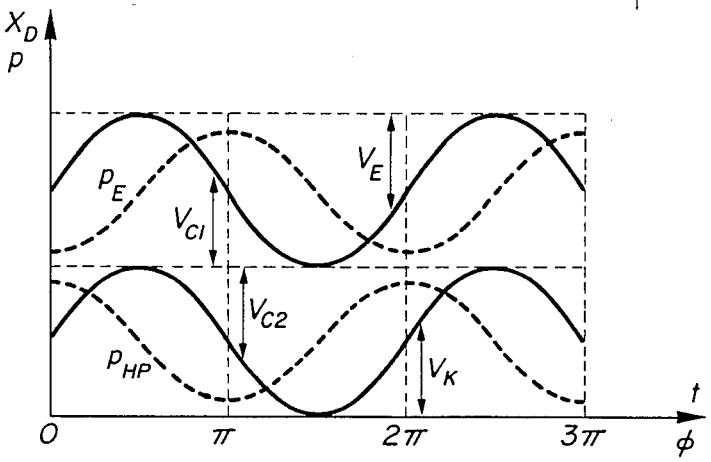
FIG. 2 is a diagram intended to explain the principle of the resonance tube.

The diagram in FIG. 2 illustrates the variations in volume and pressure in each of the two compartments. The bottom of the diagram refers to the heat pump compartment 6 and the top to the engine compartment 1.

It will be seen that in the engine compartment 1 the displacer piston (continuous line) precedes the pressure wave (broken line) so that the gas in the engine compartment will always expand when the hot expansion volume is large, and vice versa, compression taking place when the compression volume is large.

In the heat-pump compartment 6, the pressure rise also takes place at a large compression volume and expansion at a large expansion volume.

The highest gas pressure in the engine compartment takes place during the downward movement of the piston causing the gas to flow from the compression volume $V_{C1}$ to the expansion volume $V_E$. This gas picks up the heat from the regnerator, causing its expansion, which increases the pressure wave. Part of the energy transferred to the pressure wave transmitted by the resonance tube will then be absorbed by the reverse process taking place in the heat-pump compartment 6.

Since the gas in the compression compartments $V_{C1}$, $V_{C2}$ is kept at a basically constant temperature level, the effect of the movement of the displacer pistons on the column of gas in the resonance tube 16 is similar to that of a piston actuated by a periodic external mechanical force.

In this design, the cyclic pressure change in the engine compartment is produced by a periodic change of the mass of gas it contains, instead of following upon the movement of a piston. To avoid an excessive heat flow produced by the engine compartment it will be assumed that the mass flow enters and leaves the engine compression volume under substantially isothermal conditions.

Mathematical simulations have been carried out on the basis of the model developed by R. Tew et al at the NASA-Lewis Research Centre and published in 1978. All that is required to adapt this model is to specify additional data in the form of the rate of mass flow of gas forming the subject of an exchange with the exterior, in dependence on the time and the temperature of the gas entering the system. Since the pressure differs solely because of the friction losses between the expansion and compression chambers, the work transmitted to the displacer piston is proportional to the differential surface SV in the case of the engine (FIG. 1), and (SV-SW) in the case of the heat pump respectively. One example of dimensioning of these surfaces will be given hereinafter. The fraction of energy transmitted to the displacer pistons is therefore small compared with the total energy produced in a cycle. The essential part of the work is transmitted to the column of gas in the resonance tube 16 and thus serves to drive the pressure wave in said tube and hence actuate the associated heat pump.

We shall now examine the questions concerning the dimensions of the resonance tube 16. The length of this tube must first be defined in order to bring about the resonance conditions required to bring the column of gas it contains into resonant oscillation in order that the engine and heat-pump compartments can be connected.

This length of the resonance tube depends on the configuration of the assembly, the oscillation frequency f, and the speed of sound a in the gas used which, in this example, is helium. As a first approximation, and in the case of the configuration shown in FIG. 1 in which the engine compartment 1 and the heat-pump compartment 6 are respectively situated at the two ends of the resonant tube 16, the length L of said tube is equal to half the acoustic wave length propagated in the working medium:

$L=\lambda/2=a/(2.f)$ with He at $T\sim 300°$ K.;

$a\sim 1000$ m/s $f=50$ Hz $L=1000$ m/(2·50) 10 m

Wave propagation in a tube of constant section comes up against the problem of the formation and propagation of shockwaves. To avoid this phenomenon, the tube section must be variable. If the section is convergent with respect to the direction of wave propagation, the waves are progressively reflected. For that reason the resonance tube 16 connecting the compartments 1 and 6 in FIG. 1 will preferably have two conical sections 16*a* and 16*b* respectively, each converging towards the compartments 1 and 6 to which their ends are connected, said conical sections being connected to one another by a cylindrical portion.

To dimension the resonance tube of non-constant section, the determination of the periodic flow of gas in the tube must be taken into account. This calculation is based on the method of the characteristics in a field of flow x, t (length—time) described by Ascher H. Shapiro in "The Dynamics and Thermodynamics of Compressible Fluid Flow", the Ronald Press Company, New York 1953. According to this method, the differential equations constituing the movement of the gases (conservation of mass, quantity of movement and energy) are converted to a set of total differential equations which are valid along the characteristic lines. Starting from given initial conditions, with these equations it is possible to determine the conditions of state and flow of the gas obtaining after each increment of time $\Delta t$ over the entire period of the oscillation cycle and over a plurality of consecutive cycles until periodic flow conditions are established.

This method allows for the friction of the gas on the walls, the heat exchange through the walls, and the changes in the section of the resonance tube.

To determine the limiting conditions associated with the resonance tube, the conditions of the gas in the Stirling engine and/or heat pump part of the assembly are also determined by a succession of time increments in dependence on the movement of the pistons and the gas exchange with the resonance tube.

For the limiting conditions of the Stirling compartments of the assembly, the movement of the pistons is initially fixed in accordance with given kinematics. Once the calculation result approaches the required periodic conditions, the movement of the free pistons can be determined in dependence on the whole of the forces acting on them. In the case of stability of the assembly, periodicity is maintained both for the displacer piston movements and for the movement of the gas.

Determination of the shape of the tube and its length for a given oscillation frequency f is an implicit result of the calculation. This method enables a choice to be made between the shapes and dimensions of tubes in which harmonic pressure waves are established. Resonance conditions are established when the maximum pressure variations are reached. Amongst the solutions that can be considered, those which give a high performance factor for the whole system are selected.

Taking into account friction losses of the gas (helium or hydrogen), calculations have shown that its speed of flow in the resonance tube must remain below about 80 m/sec. It is also apparent from these calculations that the friction power dissipated in the resonance tube must remain below about 25% of the mechanical power generated in the engine part of the Stirling system, and this represents about 10% of the thermal power delivered at high temperature to the system.

The best calculated results were obtained with cross-sectional ratios of the conical part of the tubes lying between 5 and 10, preferably between 7 and 8.

The size of the smallest section adjacent the engine and/or heat pump part must be fixed in dependence on the volume rate of flow of gas to be displaced and depends primarily on the oscillation pressure ratio to be established and on the dead volume of the Stirling part under consideration. This latter point is of capital importance for the complete system, because appropriate choice of the section of the resonance tube enables Stirling systems to be considered which have relatively high dead volumes. These resonance tube systems are therefore less sensitive to the dead volume of the Stirling part than in other free-piston systems. Consequently, the heat exchange surfaces can be dimensioned more comfortably than in other known systems, thus increasing the overall performance factors.

The movement of the displacer pistons 2 and 7 subjected to a harmonic pressure wave established in the resonance tube 16 will now be analyzed. For reasons of simplicity it will be assumed that the pressure $P_E$ at one end of the tube is exactly opposite the pressure $P_{HP}$ at the other end. The size of the wave is considered as being independent of the movement of the displacer pistons themselves.

To determine the dimensions of the pistons 2 and 7, the pressure wave is assumed to drive them in a forced harmonic oscillation.

The differential equation of the movement of such a system having one degree of freedom may be expressed as follows:

$$mx+cx+kx=F_o \sin(\omega t)$$

where m=mass of the pistons c=damping coefficient k=spring constant $F_o=-p_E \cdot S_V+P_{HP} \cdot (S_V-S_W)$ $|F_o|=p_E(2S_V-S_W)$ driving force.

The specific solution of this equation is a standing oscillation of the same frequency as that of the excitation of the form:

$$x=X \cdot \sin(\omega t-\phi)$$

where X is the oscillation amplitude and $\phi$ is the phase-shift of the movement with respect to the excitation force. Substitution in the differential equation gives:

$$X=\frac{Fo}{(k-m\omega^2)^2+(c\omega)^2}$$

and $$\phi=\tan^{-1}\frac{c\omega}{k-m\omega^2}$$

Figure 3:
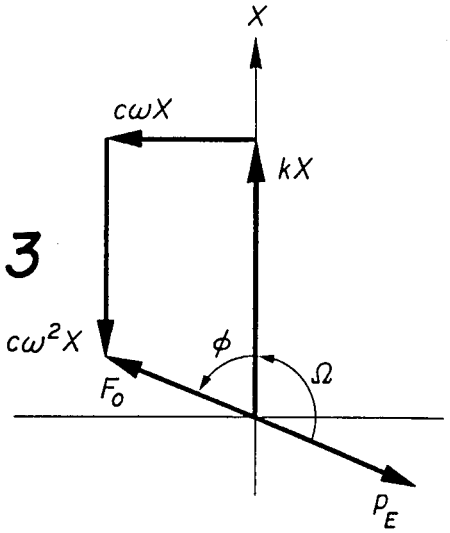
FIG. 3 is a diagram showing the vectorial relationship for the forced harmonic oscillation of the free piston.

The individual forces making up the differential equation are shown graphically in FIG. 3 (speed and acceleration are ahead of the movement by 90° and 180° respectively).

Figure 4:
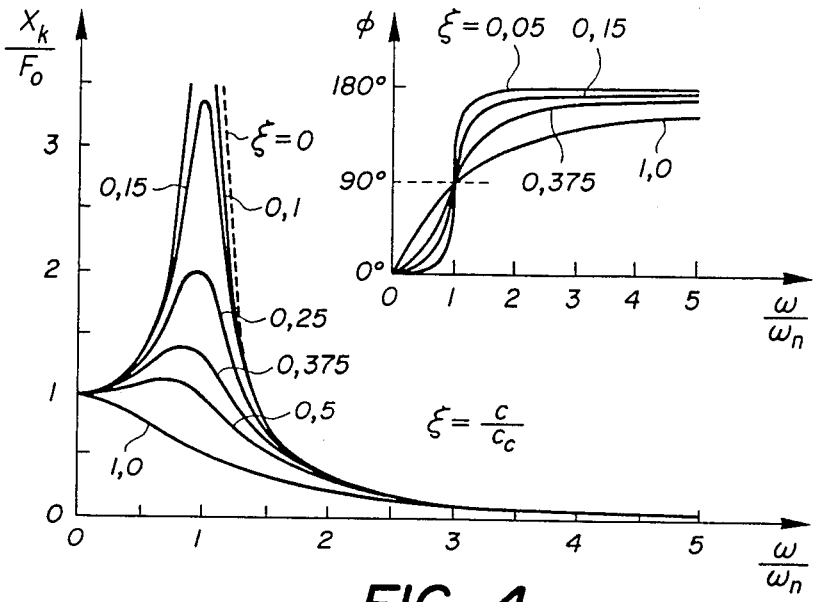
FIG. 4 is a diagram showing the amplitude and phase angle for a forced harmonic oscillator.

Using the terms:

$\omega_n=k/m$=natural frequency of undamped oscillation $C_c=2\ m\omega_n$=critical damping, it is possible to represent the above equations in a dimensionless form, the results of which are shown in the diagram in FIG. 4 taken from the 2nd edition of "Theory of vibrations with applications by William T. Thomson, Prentice-Hall Inc., Englewood Cliffs, N.J." The dimensionless amplitude $Xk/F_o$ and the phase angle $\phi$ are dependent only on the frequency ratio $\omega/\omega_n$ and the damping factor $\xi=C/C_c$. The curves show that the damping factor has a considerable influence on the amplitude and phase angle, particularly in the frequency zone close to resonance.

By way of example we shall now examine the dimensioning of the double free displacer piston 2, 7 in FIG. 1, and particularly the sections SV and SW, by reference to a numerical example.

The working conditions are as follows:

Working gas; Helium

Maximum volume of expansion chamber:

$V_{EM}=120\ cm^3$

Diameter D1=7 cm, stroke=3 cm, swept volume $V_S=115\ cm^3$)

(Diameter D2=7 cm)

Frequency: FREQ=50 $s^{-1}$($\omega=314\ s^{-1}$)

Average cycle pressure $P_{AVG}=30.10^5$ Pa

Pressure ratio=$p_{max}/p_{min}=40/20=2$

The dimensions of the engine part of the assembly correspond to those of the engine used by W. R. Martini, Director of Martini Engineering 2302 Harris, Richland, Wash. 99352, in "A simple method of calculating Stirling engines for engine design optimization". The different data relating to this engine, heat exchange, output, etc. are known.

It will be assumed that the temperature of the tubes of the hot part $T_{MH}$ is 980° K. and of the cold part $T_{MC}$ 330° K. and that the energy transferred by the engine part to the resonator is approximately $N_W \sim 2670$ W. An optimized Stirling engine compartment of similar dimensions operating without wave exchange processes would allow the production of a mechanical energy of $$N \simeq 0.15\ p\ f\ V_S \simeq 2600\ W$$

Assuming that the maximum frictional energy losses $N_f$ of the piston are less than 20% of the nett engine energy, it is possible to evaluate an equivalent viscous damping factor $C_{eq}$ resulting from a similar energy loss:

$$N_f=0.2\ N \simeq 0.03\ p\ V_S \cdot f=\frac{C_{eq}}{2}\omega^2 X^2$$

where $$C_{eq} \simeq \frac{0.03\ p\ s_1}{\pi\ \omega\ X}$$

In the case of the numerical example given above, $$C_{eq} \simeq 12\ kg \cdot s^{-1}$$

where, with $$C_c=2m\omega_n \sim 2.1.5\ kg.314^{-1}=940\ kg.s^{-1}$$

$$\xi=C_{eq}/C_c=0.02$$

From the diagrams in FIG. 4 it will be seen that the movement of the displacer pistons 2 and will be very sensitive to modifications of the spring constant or of the damping ratio, which is very comparable to the behaviour of the displacer pistons in the Beale or Benson free-piston systems. The variation of these parameters will enable the behaviour of the assembly to be very closely influenced.

The diagram in FIG. 4 shows that in the case of an also weak damping a phase angle $\phi$ greater than 45° will exist only when the natural frequency of undamped oscillation $\omega_n$ is very close to the frequency of the excitation force:

$$\omega_n=\sqrt{k/m} \sim \omega$$

-continued $$k = \omega^2 \cdot m = (314s^{-1})^2 \cdot 1.5\ \text{kg} \simeq 10^5\ \text{kg}\ s^{-2}$$

A pneumatic spring operating with the same pressure oscillates when the working gas has an elastic stiffness:

$$k = \frac{p \cdot S_W}{X} \cdot \frac{\pi - 1}{\pi + 1}$$

This enables us to deduce the section $S_W$ of the pneumatic spring in FIG. 1:

$$s_W = \frac{kX}{p} \cdot \frac{\pi + 1}{\pi - 1} \sim 15\ \text{cm}^2$$

The minimum drive force $F_o$ of the free piston can be determined frm the estimated frictional energy losses:

$$N_f \leqq \omega \cdot X F_o$$

On the other hand, the driving force $F_o$ is a relationship of the surface differences of the pistons:

$$f_O \sim p_E(2S_V - S_W)$$

from which we may deduce:

$$S_V \geqq \tfrac{1}{2}(N_f/(\omega X p_E) + S_W)$$

by expressing it numerically from the numerical example:

$$S_V \geqq 8.0\ \text{cm}^2 (D_V \geqq 3.2\ \text{cm})$$

The above evaluations of the sections $S_V$ and $S_W$ depend essentially on the assumed mass m of the displacer pistons 2 and 7 and the friction forces acting on these pistons. These depend basically on the width of the seals 9 and 15 (FIG. 1) subject to high pressures, and hence the diameter of the sections $S_V$ and $S_W$. These frictional forces obviously also depend on the type of seal used. However, the assembly described operates with only two seals using cylinders of relatively small diameters. The elimination of a large diameter drive cylinder is from this aspect a considerable impovement technologically while enabling the frictional losses to be reduced.

The assembly comprising a double free piston and just one pneumatic spring volume appears to be particularly suitable for energy regulation. One possibility is to use a linear alternator to control the phase angle $\phi$ of the movement of the free piston in relation to the pressure wave. This phase angle can also be controlled by a slight variation in the volume of the dead space of the pneumatic spring. Another possibility is to vary the average pressure of the working gas which, in combination with one of the other two solutions, would enable the energy produced to be controlled over a wide range of operating conditions.

Figure 5:
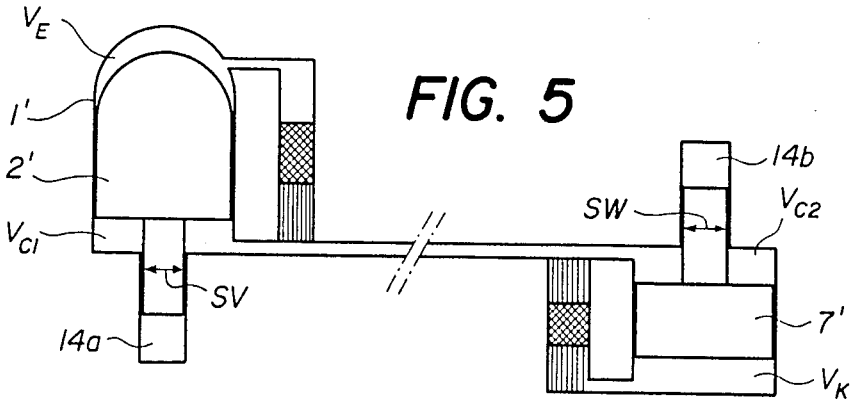
Figure 6:
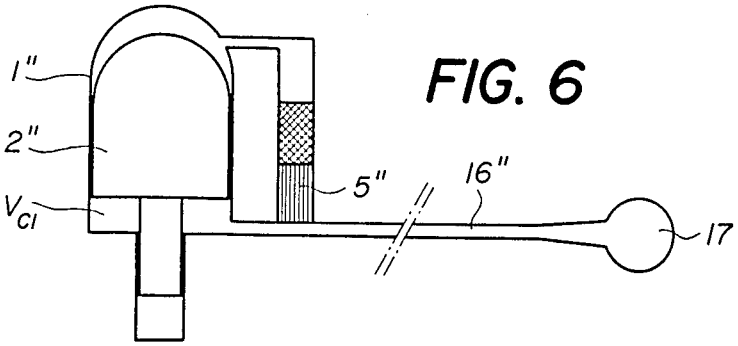

FIGS. 5 to 7 illustrate three variants of the assembly according to this invention. FIG. 5 shows a configuration which differs from that shown in FIG. 1 only in that the two displacer pistons 2' and 7' are independent of one another, so that each has a rod $S_V$, $S_W$ working with a volume of gas 14*a*, 14*b* acting as a pneumatic spring.

The variant shown in FIG. 6 comprises just one engine compartment 1'' and a displacer piston 2''. In this case, the resonance tube 16'' leads to a dead volume 17 and it is the tube itself which acts as a heat pump, as explained by the diagram in FIG. 8. One end of this tube is connected to the compression volume $V_{C1}$ of the engine compartment 1'', which is in turn associated with a heat exchanger 5'' intended to cool it. The x-axis of the graph in FIG. 8 shows a length scale L while the y-axis shows a temperature scale T. The broken line represents the temperature of the resonance tube wall. The solid line shows the flow of gas, which is at low pressure when it flows towards the engine compartment (arrow $F_1$) and high pressure when it flows towards the dead volume 17 (arrow $F_2$). The line $T_C$ represents the temperature of the cooling water of the compression volume and the line $T_K$ the temperature of the cold source of the heat pump. It will be seen that a part of the tube remote from the compression volume which is on the left of the y-axis in the diagram has a temperature below the temperature $T_K$ of the cold source and therefore absorbs heat while the part of the tube which leads to the compression volume $V_{C1}$ of the engine compartment has a temperature above that of the cooling water which absorbs the heat and can serve as heating fluid.

Finally, FIG. 7 shows a variant comprising a combination of an engine and heat pump assembly with two free and independent displacer pistons 2* and 7* each associated with a seal 18* and 19* respectively and suspended elastically by two springs 14*a**** and 14*b** respectively, comprising a resonance tube 16* connected to the compression volumes $V_{C1}$, $V_{C2}$ of the engine compartment 1* and the heat pump compartment 6*, which compartments are in turn in communication with one another. As in the case of the embodiment illustrated in FIG. 1, the expansion volume $V_E$ of the engine compartment 1* is connected to the compartment $V_{C1}$ by heat exchanger 3* associated with a hot source (not shown), a regenerator 4* and a heat exchanger 5* associated with a cold source. With regard to the heat pump compartment 6*, its compression volume $V_{C2}$ and expansion volume $V_K$ are connected by a heat exchanger 10* associated with a low temperature heat source, a regenerator 11* and a heat exchanger 12* intended to give up heat. In order that the displacer pistons 2* and 7* may have a sinusoidal movement in response to the pressure variations, the active surfaces must be different on the two sides of these pistons. The respective sections of the spring 14*a** and 14*b**** respectively reduce the active surface of the piston on the side of the compression volume compartments $V_{C1}$ and $V_{C2}$ respectively.

The major disadvantage of the known VM system lies mainly in the pressure ratios, which remain too small, so that the energy pumping efficiency is low.

In the solution recommended here, in which the two engine and heat pump parts are connected by a resonance tube, the pressure varies periodically as a result of the movement of a wave in said resonance tube. The system only has to be designed in such a way that a small amount of energy is periodically delivered to the resonance tube in order to keep the pressure wave in oscillation. This combination, which is based on the above-mentioned VM cycle principle, enables the pressure ratio of the working gas to be basically increased, thus increasing the energy density and the total efficiency of the assembly as compared with the known VM system.

As a result of this condition, the heat pump compartment can be designed with a displacement volume at least twice greater than that of the engine compartment. This gives a large movement of working gas in that part of the cycle, and this contributes to a considerable energy pumping.

In the solution proposed, the pressure variation is not directly associated with the dead volumes of the Stirling part, but depends basically on the quality of the resonator. Consequently it is possible to dimension the heat exchangers more comfortably, increase the exchange surfaces and reduce the thermal losses due to imperfect exchanges. It is also possible to accept dead volumes at the end of the movement of the free pistons, thus facilitating construction. It is therefore possible without disadvantage to consider the use of springs 14a* and 14b* of the helical bellows type which produce relatively large dead volumes, whereas such a solution would have an unacceptably adverse effect on any other heat pump system of the Stirling type.

With this type of mechanical suspension of the displacer pistons 2* and 7*, each piston is held in a position of fixed equilibrium and oscillates about that position. Consequently no centring system is required to compensate for any drift of the piston. The frequency of oscillation of the pistons, and of the resonance tube, become independent of the gas pressure. As a result, it is possible to vary the heating power by varying the average pressure of the system. The overall performance or gain factor of the heat pump assembly will therefore remain substantially independent of the load or seasonal variations in heating demand.

This solution does away with dynamic seals in which there is a large pressure difference between two compartments which have to be isolated. The only two seals remaining on the free pistons are subjected to very low differential pressures. The frictional forces and the internal leakage flow in the system are therefore greatly reduced, and this contributes to its good total efficiency. An assembly of this kind has practically no part subject to wear, and this reduces maintenance problems.

Different tests have been carried out to test the behaviour of the resonant tube in order experimentally to check the possibility of keeping a sinusoidal pressure wave in permanent movement with minimum energy supply.

Two resonant tube configurations were used for this purpose. The first of these configurations comprises a tube whose section varies to a parabolic law (corresponding substantially to a cone) of 1.8 m length, the smallest section of which is 2.5 $cm^2$ and the largest 15.2 $cm^2$. The small section is connected to a cylinder in which is disposed a piston actuated in accordance with a sinusoidal movement by a link mechanism. The dead volume of the cylinder can vary from 150 to 300 $cm^3$ and the piston movement volume can range from 19 to 38 $cm^3$. The major section of the conical tube is connected to a cylindrical tube whose section corresponds to the major section of the conical tube and the length of which is 1.2 m and ends in a dead volume of about 5 1.

The second configuration differs from the first solely in that the 5 1 dead volume is replaced by a second conical tube 1.2 m in length, the largest section of which corresponds to that of the cylindrical tube, i.e. 15.2 $cm^2$, and the smallest section of which is 5 $cm^2$.

During tests, the gas used was nitrogen at an average pressure of between $1.10^5$ and $2.10^5$ Pa. The variation in the frequency of the piston driven by a d.c. motor enables the resonance conditions of the column of gas to be determined. The dead volume of the cylinder in first approximation simulates that of the Stirling system. Tests have shown that with a frequency of between 45 and 50 Hz, depending upon the configuration of the tube and an energy supply of less than $E \leqq 1$ J per cycle, it is possible to keep the column of gas in oscillation with pressure ratios in the cylinder $\Pi = p_{max}/p_{min}$ ranging between 1.7 and 2.0 as shown by diagram in FIG. 9 obtained from a recording on an oscilloscope.

The diagram in FIG. 10 also recorded during tests shows firstly a curve A corresponding to the movement of the piston in the cylinder and, secondly, a curve B corresponding to the corresponding pressure variation in the resonance tube. This recording shows that the pressure variation in dependence on time is effectively close to a sinusoidal variation of the kind required in a VM type free-piston heat pump.

These results confirm those obtained by means of the calculation program based on the characteristics method. These calculations show that it is possible to design a VM system with a resonancetube operating with helium as the working gas at average pressures of between $2.10^6$ and $5.10^6$ Pa and at oscillation frequencies of the order of 50 Hz.

The pressure ratio during the oscillations will be between $\Pi = p_{max}/p_{min} = 1.3-1.5$ depending on the dimensions of the engine and heat pump assembly, and the coefficient of performance COP will be between $1.40 \leqq COP \leqq 1.80$. The COP corresponds to the ratio of the useful heating power and the heating power delivered to the hot source of the engine compartment of the engine and heat-pump assembly.

If this range is compared with the efficiency of a conventional boiler the achievable energy gain is between 30 and 45%.

Figure 11:
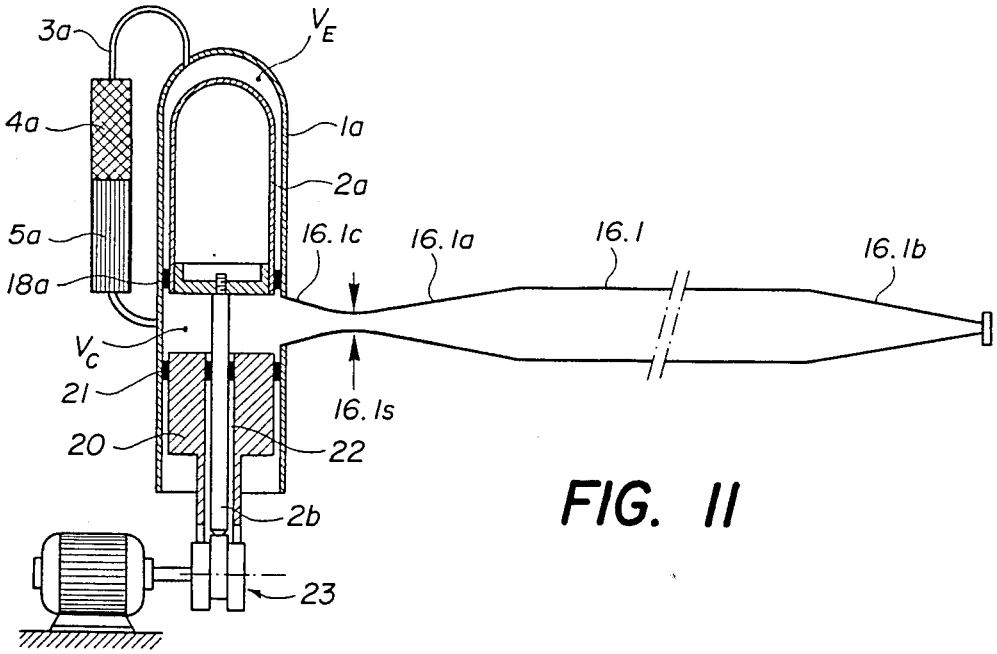
FIGS. 11 to 14 show four other asepcts of the machine according to the invention.

Although an assembly comprising a Stirling engine and heat pump has been described up till now, this being a preferred application of the invention in view of the great simplification resulting from the coupling between the engine and the heat pump, the invention is not limited to just that embodiment. For example, a resonance tube can be placed on a Stirling machine on its own, as shown in FIG. 11, which represents a cryogenerator.

This machine comprises a displacer piston 2a in an engine compartment 1a, a seal 18a separating the expansion volume $V_E$ and the compression volume $V_C$, which is in turn defined by a second piston 20 surrounded by a seal 21. An axial passage 22 extends through said piston and enables a rod 2b integral with the displacer piston 2a to access an engine cam shaft 23 which also controls the movement of the second piston 20.

As before, the expansion volume $V_E$ and the compression volume $V_C$ are connected by a heat exchanger 3a intended to absorb the heat, a regenerator 4a and a heat exchanger 5a adapted to yield heat.

A resonancetube 16.1 is connected to the compression volume $V_C$. This resonance tube is closed at one end like the one shown in FIG. 7, and comprises a portion 16.1a of progressively increasing section, a portion 16.1 of constant section and a portion 6.1b of decreasing section. The end of the portion 6.1a which is connected to the compression volume $V_C$ is connected to this volume via a portion 16.1c which flares out slightly so that the smallest section of this portion 16.1a is situated in the part 16.1s which is situated slightly withdrawn from the compression volume $V_C$. This configuration, which is applicable to all the previous embodiments,is intended for better recovery of the dynamic energy of the gas during its reciprocating movement and thus to reduce the losses of this resonance tube. In this application the resonance tube 16.1 enables the pressure ratio to be increased between the volumes $V_E$ and $V_C$ and hence enables a better efficiency to be obtained for the same machine size. Of course it would be possible to reverse the operation of the machine described in FIG. 11 by delivering heat energy by means of the heat exchanger 3*a*, which would then enable it to operate as an engine delivering mechanical energy to a crankshaft which would replace the camshaft 23.

Other variants of the engine and heat-pump assembly are also feasible. For the sake of simplification they are shown only very diagrammatically.

Figure 12:
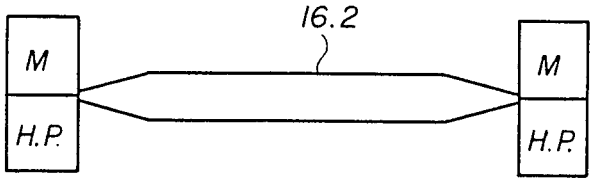

FIG. 12 shows two engine M and heat-pump HP assemblies which are similar to those in FIGS. 1 or 7, for example, and which are connected to one another by a resonance tube 16.2.

Figure 13:
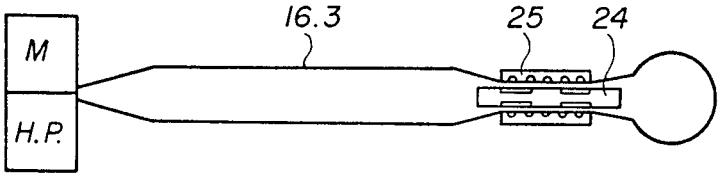

FIG. 13 shows another variant in which some of the pressure energy of the resonarce tube 16.3 is used to move a piston which carries permanent magnets 24 and which is housed in the resonance tube, with respect to a coil 25 in which a voltage is induced. This solution may be used in the case of an installation in a remote place without electric power, and also gives an electrical power source which can replace a small generator set for relatively low powers and be used to control the machine and drive the auxiliaries of the Stirling machine (fans of the air burner and water pumps).

Figure 14:
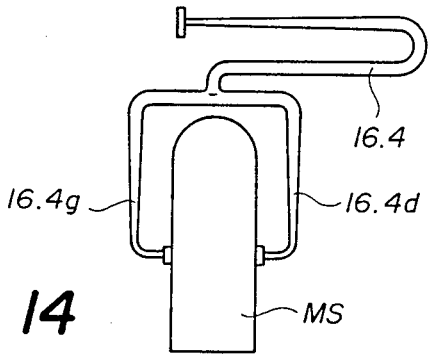

The pressure waves from the resonance tube generate lateral forces on the pistons of the Stirling machine MS (FIG. 14). To balance these forces the resonan tube 16.4 can be divided into two arms 16.4*g* and 16.4*d* which merge to form just a single tube. Advanta9eously, this may be a U-shaped tube 16.4*e* to balance the forces acting along the tube.

What is claimed:

1. A Stirling machine comprising a cylinder, a displacer piston mounted in the cylinder to define two variable-volume compartments for the compression and expansion respectively of a gaseous working fluid contained in said machine, a conduit providing communication between the compression compartment and the expansion compartment, a heat exchanger in said conduit. adapted to be associated with a hot source, a regenerator in said conduit, and a heat exchanger in said conduit adaPted to be associated with a heat sink, and an oscillatory member synchronized with said displacer piston. characterised in that the said oscillatory member is a resonance tube tuned to the frequency of the said piston, and a return means associated with the end of said piston defining the said compression compartment is provided for effecting return motion of said piston.

2. A combination, a Stirling heat pump and a Stirling engine in driving relation therewith, in which said Stirling engine is a Stirling machine as claimed in claim 1, characterised in that the said displacer piston of said engine is a free piston, the said oscillatory member is a drive member for transmitting to said heat pump, the energy produced by the Stirling engine. the structure of said heat pump is the counterpart of that of said engine, and said return means associated with said displacer piston is an elastic return means.

3. A Stirling machine according to claim 2, characterised in that the said resonance tube comprises two segments of respective varying cross-sections which increase progressively with increasing distance respectively from said engine and said heat pump, and a cylindrical third segment connecting the respective major cross-sections of said two conical segments.

4. A Stirling machine according to claim 2, characterised in that the elastic return means comprise a cylinder closed at one end, and other end receiving in sealing-tight relationship a rod integral with the displacer piston.

5. A Stirling machine according to claim 2, characterised in that it comprises two free displacer pistons, one associated with said engine and the other with said heat pump, each said piston co-operates with a return spring, and compression volume compartments associated with each of said free pistons are connected to one another and to said resonance tube.

6. A Stirling machine according to claim 2 characterised in that it comprises two free displacer pistons, one associated with said engine and the other with said heat pump, each of said pistons co-operates with a return spring and compression volume compartments associated with each of said free pistons are connected to the same end of said resonance tube.

7. A Stirling machine according to claim 1, characterised in that each end of the resonance tube is connected to a respective Stirling machine and forms said oscillatory member synchronized with the displacer piston of each of these machines.

8. A Stirling machine according to claim 2, characterised in that a piston is mounted for longitudinal oscillation in said resonance tube, and said piston constitutes the movable member of a linear electrical machine operating as a generator.

9. A Stirling machine according to claim 2, characterised in that a piston is mounted for longitudinal oscillation in said resonance tube, and said piston constitutes the movable member of a linear electrical machine operating as a motor.

10. A Stirling machine according to claim 1, characterised in that the said resonance tube is divided into two symmetrical portions on either side of a plane containing the axis of movement of said displacer piston, and further comprises a common tube having two parallel arms connected by a bent portion, said common tube having one and thereof connected to both said symmetrical portions.

* * * * *